US005224893A

United States Patent [19]

Routzong et al.

[11] Patent Number: 5,224,893

[45] Date of Patent: Jul. 6, 1993

[54] BUBBLE PRODUCING TOY

[75] Inventors: James E. Routzong, Manchester-By-The-Sea; Brian K. Lapointe, Rockport, both of Mass.

[73] Assignee: Cap Toys, Inc., Bedford Heights, Ohio

[21] Appl. No.: 981,879

[22] Filed: Nov. 25, 1992

[51] Int. Cl.[5] ..... A63H 33/28

[52] U.S. Cl. ..... 446/15; 446/266

[58] Field of Search ..... 446/15-21, 446/266, 236

[56] References Cited

U.S. PATENT DOCUMENTS

| | | | |
|---|---|---|---|
| 2,391,797 | 12/1945 | Raspet | 446/21 |
| 2,398,513 | 4/1946 | Bradley | 446/15 |
| 3,745,693 | 7/1973 | La Fata et al. | 446/15 |
| 4,919,417 | 4/1990 | Poulas . | |
| 5,102,381 | 4/1992 | Danielak et al. | 446/15 X |

*Primary Examiner*—Mickey Yu

[57] ABSTRACT

A bubble producing toy which resembles a spinning baton. It includes a handle and a cross-member rotatably mounted on the handle. A liquid bubble solution is stored in a reservoir in the hub of the cross-member. A pair of oppositely extending arms form part of the cross-member. A bubble diffuser is attached to the outer end of one of the arms and an imitation bubble diffuser is attached to the outer end of the other arm. The bubble diffuser arm is hollow and functions as a conduit to deliver the liquid bubble solution to the diffuser. The diffuser has a rotating wand which is driven by the rotation of the cross-member relative to the handle. The wand wipes a film of liquid bubble solution across elongated openings in the bubble diffuser. Air passing through passages in the rotating wand and the bubble diffuser creates bubbles from the liquid bubble solution film.

3 Claims, 2 Drawing Sheets

BUBBLE PRODUCING TOY

BACKGROUND AND SUMMARY OF THE INVENTION

This invention is directed to a bubble producing spinning toy resembling a baton which may be used by either a child or an adult to produce a continuous output of bubbles.

An object of this invention is a toy resembling a baton which continuously produces bubbles as it is spun.

Another object of the invention is a spinnable bubble producing toy baton having a bubble producing wand that is positively driven by the spinning of the baton.

Another object of this invention is a bubble producing toy baton in which the liquid bubble solution is fed to the bubble diffuser by centrifugal force created by the spinning of the baton.

Other objects may be found in the following specification, claims and drawings.

BRIEF DESCRIPTION OF THE DRAWINGS

The invention is illustrated more or less diagrammatically in the following drawings wherein.

DESCRIPTION OF THE PREFERRED EMBODIMENT

Figure 1:
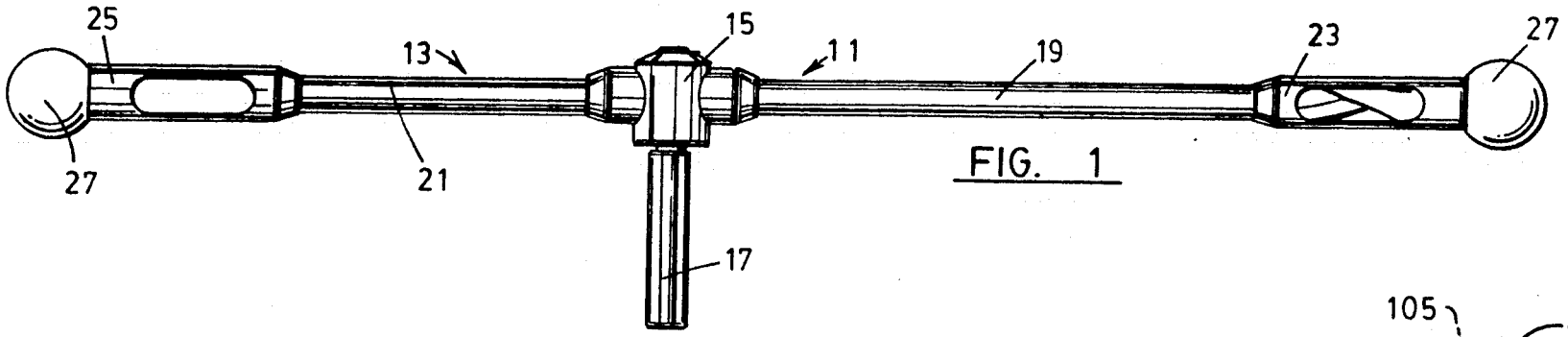
FIG. 1 is a side elevational view of the bubble producing toy baton of this invention.

FIG. 1 of the drawings shows the bubble producing baton-like toy 11 of this invention. The baton includes a cross-member 13 having a hollow, cross shaped hub 15 which is mounted for rotation on a handle 17. The cross-member 13 includes a hollow arm 19 and a shorter arm 21. The arm 19 functions as a conduit for liquid bubble solution while the arm 21 is plugged. A bubble diffuser 23 is mounted at the outer end of the hollow arm 19 while an imitation bubble diffuser 25 is mounted at the outer end of the shorter arm 21. Hollow decorative knobs 27 are mounted on the outer ends of the actual and imitation bubble diffusers 23 and 25.

Rotation of the handle 17 is transmitted to the cross-member 13 by means of a metal shaft 31 having an enlarged knurled head 33 which is anchored in the handle 17. The knurled head is seated in the base 35 of an enlarged longitudinal passage 37 formed in the handle 17. The shaft 31 extends out of the handle through a reduced diameter passage 39 in the handle and through a passage 41 formed in a plug 43 closing one of the openings 45 into the hollow hub 15. A bearing-like washer 47 is located between the plug 43 and the handle 17.

I addition to mounting the cross-member 13 for rotation relative to the handle 17, the shaft 31 also drives a wand portion of the bubble diffuser 23 in a manner to be hereinafter described. A bevel gear 51 is affixed to the end of the shaft 31 which extends into the hollow hub 15 of the cross-member 13. This bevel gear meshes with a bevel gear 53 fastened to one end of a shaft 55 which extends outwardly of a passage 57 of the hollow hub 15 and into the hollow arm 19 which is seated in the passage 57 of the hub. The shaft 55 is attached by a tubular coupling 59 to a rod 61 which extends through a plug 63 at the outer end of the hollow arm 19 and into the bubble diffuser 23. The rod 61 has an enlarged integral head 65 which is attached to a rotatable tubular wand 67 located in a tubular housing 69 of the bubble diffuser 23. The shaft 55 is supported in the hollow hub 15 and the hollow arm 19 by bearings 71 and 73. The bearings 71 and 73 have longitudinally extending passages 75 to permit the flow of liquid bubble solution 81 to the bubble diffuser 23.

The liquid bubble solution 81 is stored in a reservoir 83 formed in the hollow hub 15. A filling passage 85 leading into the hollow hub is closed by a ca 87. The filling passage provides a means for replenishment of the liquid bubble solution in the reservoir. As the cross-member 13 is rotated relative to the handle 17, the liquid bubble solution 81 is moved by centrifugal force to the bubble dispenser 23. The bubble solution flows along the hollow arm 19 and through an annular passage 89 formed in the plug 63 surrounding the rod 61. The bubble solution then flows around the enlarged head 65 of the rod 61 to the outside surface of the rotatable wand 67.

Figure 2:
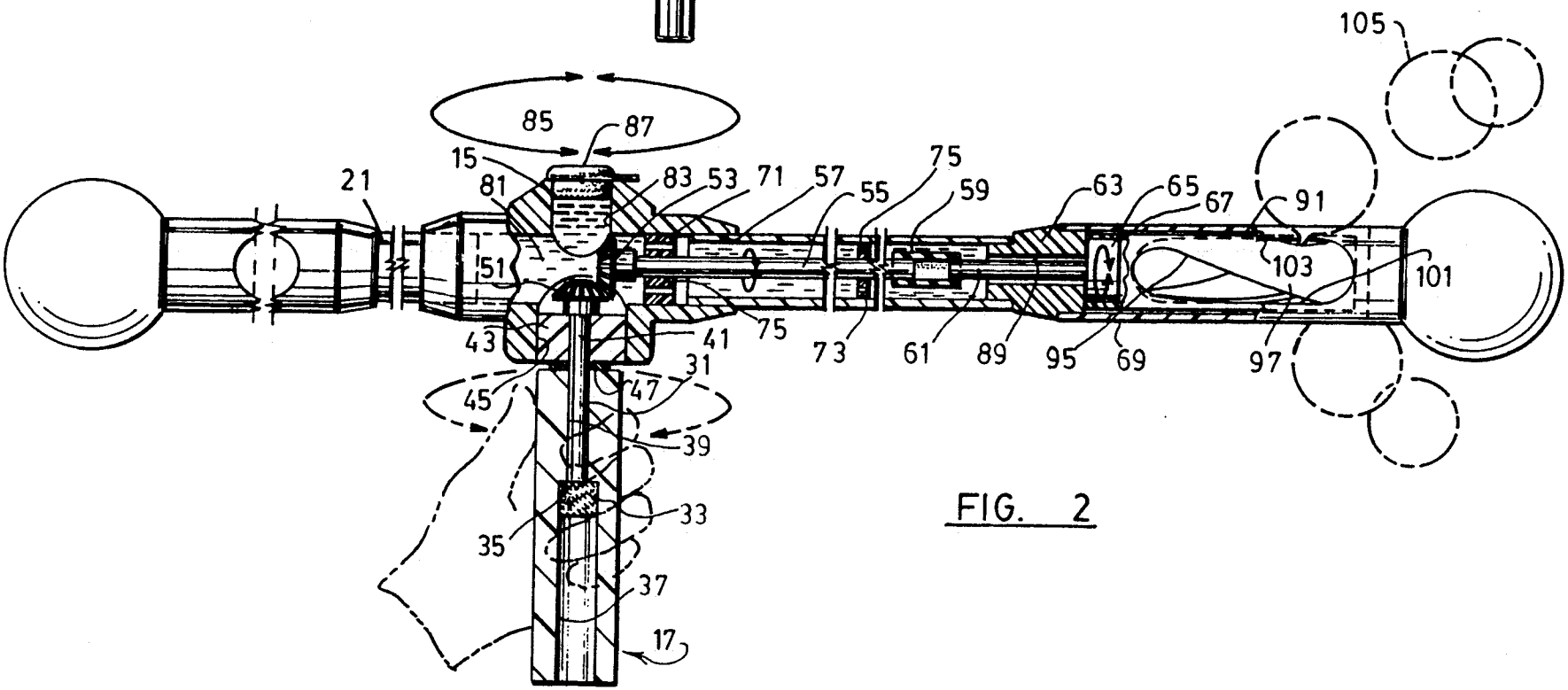
FIG. 2 is an enlarged, partial cross sectional view of the bubble producing toy baton of FIG. 1 with some parts broken away for compactness of illustration.
Figure 3:
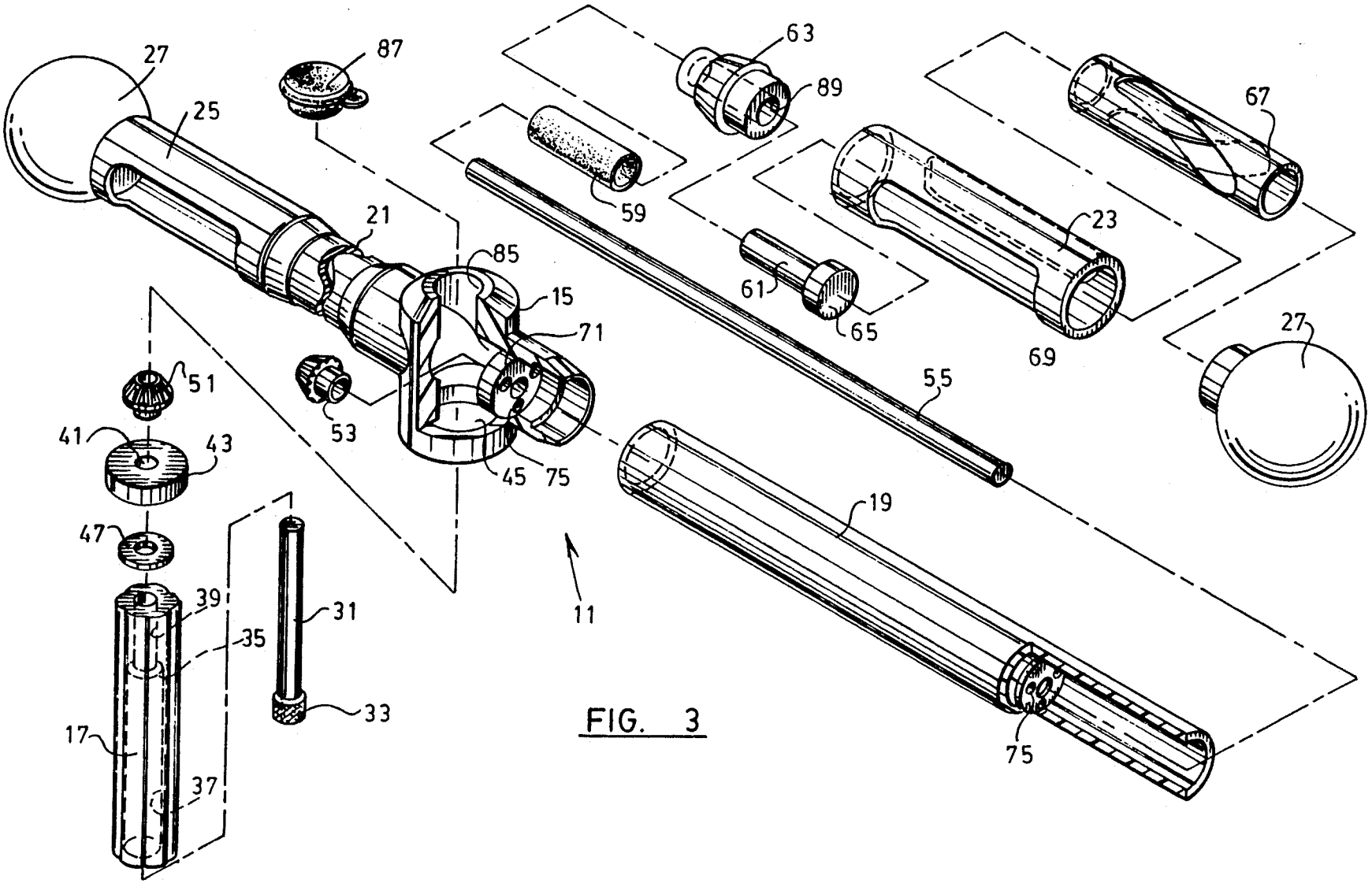
FIG. 3 is an enlarged, exploded view of the bubble producing toy baton of FIG. 1 with some parts cut away for clarity of illustration.

The wand 67 is rotatably mounted in the tubular housing 69 with an annular space 91 located between the wand and the housing. Formed in the rotatable wand 67 are a pair of diametrically opposed curved passages 95 which extend along the length of the wand. Land areas 97 formed on the outer surface of the tubular wand between the curved passages 95 pick up the liquid bubble solution 81 as the wand is rotated. Elongated straight passages 101 are formed in diametrically opposite sides of the tubular housing 67 with each passage having an edge 103. As the lands 97 on the rotatable wand 67 spread liquid bubble solution 81 across the edges 103 of the passages 101 in the tubular housing 69, a bubble film is formed across the passages 101. When the curved passages 95 of the rotatable wand 67 momentarily align with the straight passage 101 in the outer tubular housing 67 air passes through the bubble solution film to form bubbles 105 which are discharged from the bubble diffuser 23 as shown in FIG. 2 of the drawings. Thus, the rotational movement of the cross-member 13 not only forces the liquid bubble solution 81 to flow to the diffuser 23 and to spread it in films across the straight passages 101 of the bubble diffuser but the rotation of the cross-member also provides a movement of air through the aligned passages 95 and 101 to form the bubbles 105 and discharge them from the bubble diffuser 23.

The plugged arm 21 fits into a passage 109 in the hollow hub 15 and blocks this outlet passage so that no liquid bubble solution 81 flows to the imitation bubble diffuser 25. The purpose of the imitation bubble diffuser is for decorative purposes and to provide a balance for the rotating cross-member 13.

I claim:

1. A bubble producing toy including:

a handle, an arm rotatable about said handle, said arm having a bubble solution reservoir, a bubble diffuser connected to said arm, means connecting said bubble solution reservoir to said bubble diffuser, a rotatable wand positioned in said bubble diffuser, and means connecting said rotatable wand to said handle to cause said wand to rotate relative to said bubble diffuser as said arm rotates relative to said handle.

2. The bubble producing toy of claim 1 in which said bubble diffuser includes a tubular housing having diametrically opposed elongated passages extending therethrough, said rotatable wand includes a tubular member rotatably mounted inside said diffuser tubular housing, said tubular member having an outer cylindrical surface which wipes across said elongated passages of said diffuser tubular housing, and said bubble solution reservoir is in liquid communication with said outer cylindrical surface of said tubular member.

3. The bubble producing toy of claim 2 in which said tubular member of said rotatable wand has diametrically opposed passages extending through said outer cylindrical wiping surface with said passages positioned to move into and out of alignment with said diametrically opposed elongated passages of said tubular housing as said tubular member of said wand is rotated.

* * * * *